US011534665B2

(12) United States Patent
Abe et al.

(10) Patent No.: US 11,534,665 B2
(45) Date of Patent: Dec. 27, 2022

(54) GOLF CLUB HEAD

(71) Applicant: Sumitomo Rubber Industries, Ltd., Kobe (JP)

(72) Inventors: Hiroshi Abe, Kobe (JP); Kiyofumi Matsunaga, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 17/471,375

(22) Filed: Sep. 10, 2021

(65) Prior Publication Data

US 2022/0111264 A1 Apr. 14, 2022

(30) Foreign Application Priority Data

Oct. 8, 2020 (JP) ..... JP2020-170694

(51) Int. Cl.
*A63B 53/04* (2015.01)

(52) U.S. Cl.
CPC ..... *A63B 53/047* (2013.01); *A63B 53/042* (2020.08); *A63B 53/0408* (2020.08)

(58) Field of Classification Search
CPC . A63B 53/047; A63B 53/042; A63B 53/0425; A63B 53/0429; A63B 53/0475; A63B 53/0416
USPC ..... 473/324–350, 287–292
See application file for complete search history.

(56) References Cited

U.S. PATENT DOCUMENTS 6,050,904 A * 4/2000 Kuo ..... A63B 60/00 473/345
7,682,264 B2 * 3/2010 Hsu ..... A63B 53/0466 473/342
9,480,888 B1 * 11/2016 Allen ..... A63B 60/54
2002/0115501 A1 * 8/2002 Chen ..... A63B 53/047 473/324
2006/0194645 A1 * 8/2006 Sugimoto ..... A63B 60/02 473/350
2013/0331201 A1 * 12/2013 Wahl ..... A63B 60/00 473/329
2015/0038263 A1 2/2015 Ueda
2020/0171361 A1 * 6/2020 Motokawa ..... A63B 53/0437
2021/0113897 A1 * 4/2021 Halberg ..... A63B 53/0433
2021/0121748 A1 * 4/2021 Ines ..... A63B 53/047

FOREIGN PATENT DOCUMENTS

JP 2015-27373 A 2/2015

* cited by examiner

*Primary Examiner* — Sebastiano Passaniti
(74) *Attorney, Agent, or Firm* — Birch, Stewart, Kolasch & Birch, LLP

(57) ABSTRACT

A golf club head comprises a head main body and a face member. The head main body is provided with a face support portion to which the face member is fixed. The face member comprises a front plate portion, a backwardly directed portion extending backwardly of the head from the front plate portion, and a centrally directed portion extending toward of a center of the face from the backwardly directed portion. The rear surface of the centrally directed portion is fixed to the face support portion of the head main body.

18 Claims, 9 Drawing Sheets

GOLF CLUB HEAD

TECHNICAL FIELD

The present disclosure relates to a golf club head.

BACKGROUND ART

Patent Document 1 below discloses an iron-type golf club head configured by joining a face member and a face receiving portion. The face member and the face receiving portion are made of different metal materials.

The face member comprises an outer peripheral portion having a large thickness and a central portion surrounded by the outer peripheral portion and having a thickness smaller than that of the outer peripheral portion.

The face receiving portion is provided with a face mounting portion on the front side to which the face member is mounted. The face mounting portion has a substantially stepped cross section comprising an inward facing surface facing the center side of the head, and a forward facing surface facing the face side. The inward facing surface is arranged so as to face the outer peripheral surfaces of the face member, and the front facing surface is arranged so as to face the back surface of the face member.

Patent Document 1: Japanese Patent Application Publication No. 2015-27373

SUMMARY OF THE DISCLOSURE

Problems to be Solved by the Disclosure

In the golf club head described in Patent Document 1, the bending of the outer peripheral portion of the face member at the time of hitting the ball is hindered, and there is room for further improvement in the face resilience.

The present disclosure was made in view of the above problems, and the primary object is to provide a golf club head capable of improving face resilience while maintaining the joint strength between the face member and the head main body.

Means for Solving the Problems

According to the present disclosure, a golf club head having a face for hitting a ball which comprises a face center, comprises a head main body, and a face member, wherein the head main body is provided, on the front side of the head, with a face support portion to which the face member is fixed, the face member comprises: a front plate portion; a backwardly directed first portion extending backwardly of the head from the front plate portion; and a centrally directed second portion extending toward of a center of the face from the backwardly directed first portion, the front surface of the front plate portion forms at least a part of the face, and a rear surface of the centrally directed second portion is fixed to the face support portion of the head main body.

Effects of the Disclosure

In the present disclosure, since the golf club head is configured as above, the golf club head can be improved in the face resilience, while maintaining the joint strength between the face member and the head main body.

DESCRIPTION OF THE PREFERRED EMBODIMENTS

Figure 1:
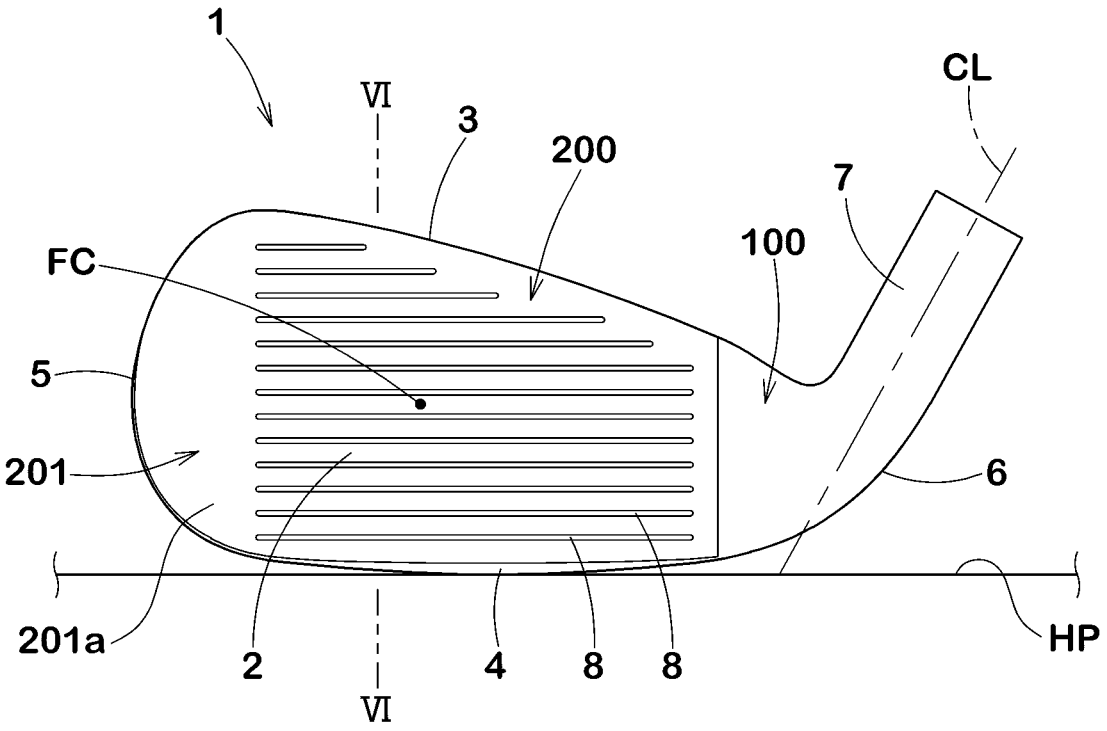
FIG. 1 is a front view of a golf club head as an embodiment of the present disclosure.

Hereinafter, embodiments of the present disclosure will be described in detail in conjunction with accompanying drawings. Throughout the embodiments, the same or common elements are designated by the same reference numerals, and redundant descriptions are omitted.

Figure 2:
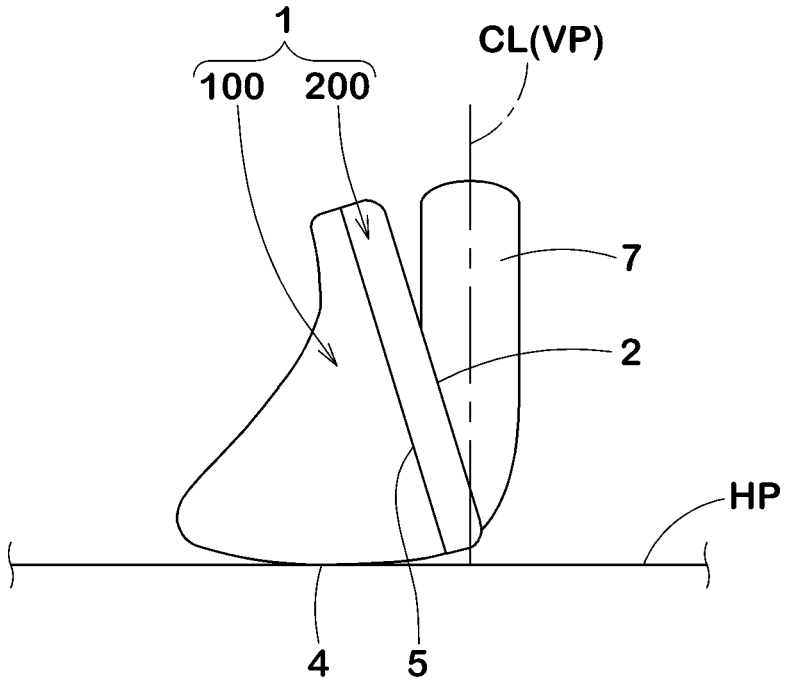
FIG. 2 is a side view of the golf club head as viewed from the toe side.
Figure 3:
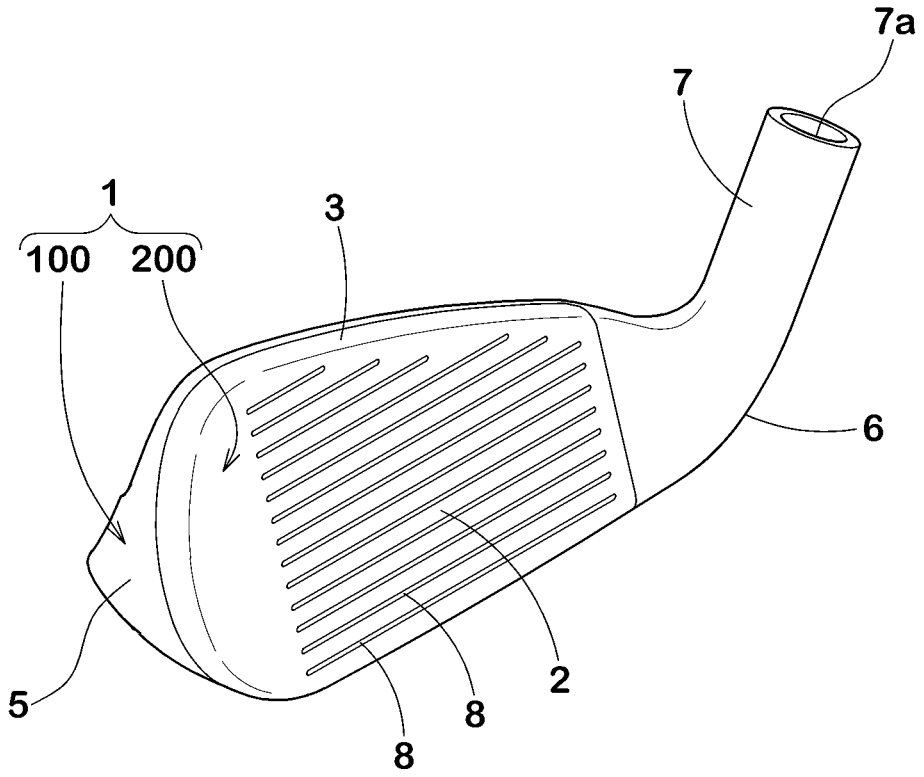
FIG. 3 is a perspective view of the golf club head as viewed diagonally from the front side.

FIGS. 1 to 3 are a front view, a side view and a perspective view, respectively, of a golf club head 1 as a first embodiment of the present disclosure.

As shown, the head 1 in this embodiment is an iron type golf club head as a preferable example. However, as other examples, the head 1 may be configured as a wood type golf club head, a putter type golf club head, or a utility type golf club head.

The head 1 in this example comprises a face 2, a top 3, a sole 4, a toe 5, a heel 6 and a hosel 7.

In FIGS. 1 to 3, the head 1 is in its reference state.

<Reference State>

In this application, the "reference state" of the head 1 means such a state that the head is placed on a horizontal plane HP so that score lines 8 formed in the face are parallel to the horizontal plane HP, the central axis CL of a shaft insertion hole 7*a* of the hosel 7 (corresponding to the axis of the club shaft) lies within a reference vertical plane VP which is orthogonal to the horizontal plane HP, and the score lines 8 are parallel to the horizontal plane HP and parallel to the reference vertical plane VP.

Unless otherwise noted, head 1 is assumed to be in reference condition.

<Definition of Directions>

The front-rear direction of the head 1 is a direction orthogonal to the reference vertical plane VP. The front side and the rear side of the head 1 mean the face 2 side and the opposite side, respectively, in the front-rear direction.

The up-down direction of the head 1 is a direction orthogonal to the horizontal plane HP. The upper side and the lower side of the head 1 mean the upper side and the lower side, respectively, in the up-down direction.

The toe-heel direction of the head 1 is a direction parallel to the horizontal plane HP and orthogonal to the front-rear direction of the head 1.

<Basic Structure of Head>

The face 2 is a surface for hitting a ball.

In the case of the iron type head in the present embodiment, the face 2 is a substantially flat surface. A plurality of score lines 8 are provided in the face 2 in order to increase friction with the ball. The score line 8 is a fine groove formed in the face 2 and extending in the toe-heel direction.

The face 2 has a face center FC. In the case of the iron type head 1 in the present embodiment, the face center FC is defined as the geometric center (centroid) of the face 2. In the case of a wood type head, the face center FC is defined as a position which is the midpoint of the length of the face in the up-down direction and also the midpoint of the length of the face in the toe-heel direction.

The top 3 extends from the upper edge of the face 2 to the rear of the head 1 so as to form an upper surface of the head 1. The top 3 may be referred to as "crown" or "upper part".

The sole 4 extends from the lower edge of the face 2 to the rear of the head 1 so as to form a lower surface of the head 1. The sole 4 may be referred to as "lower part".

The toe 5 is an end portion of the head 1 away from the hosel 7 in the toe-heel direction, and smoothly connects the top 3 and the sole 4.

The heel 6 is an end portion of the head 1, which is located on the opposite side of the toe 5 in the toe-heel direction, and to which the hosel 7 is connected.

The hosel 7 has, for example, a tubular shape and has a shaft insertion hole 7*a* into which the tip end of a club shaft (not shown) is attached. The center line CL of the shaft insertion hole 7*a* substantially corresponds to the center axis of the club shaft attached to the hosel 7.

Figure 4:
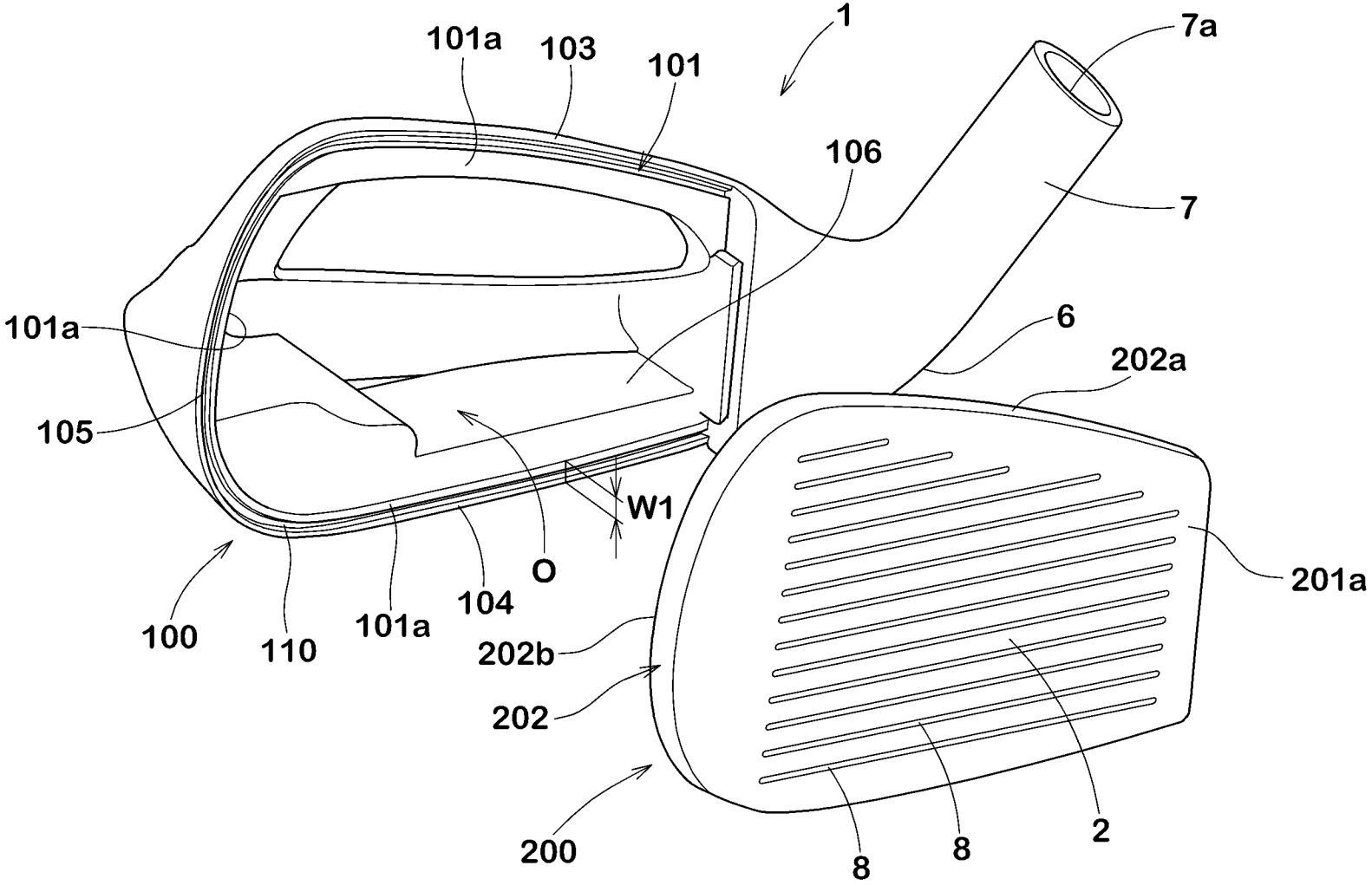
FIG. 4 is an exploded perspective view of the golf club head.

FIG. 4 is an exploded perspective view of the head 1 in the present embodiment.

As shown in FIGS. 1 to 4, the head 1 in the present embodiment comprises a head main body 100 and a face member 200.

The face member 200 is disposed on the front side of the head main body 100 and forms a part of the face 2.

<Head Main Body>

The head main body 100 is preferably made of a metal material different from that of the face member 200.

For the head main body 100, stainless steel is suitable in view of imparting an appropriate weight, strength, corrosion resistance, castability, and the like.

As shown in FIG. 4, the head main body 100 in the present embodiment is provided, on the front side thereof, with a recess O recessed toward the rear of the head.

The recess O in the present embodiment is formed by a through hole penetrating the head main body 100 in the front-rear direction. As another example, the recess O may be formed by a blind hole whose rear side is closed.

In the head main body 100 in the present embodiment, a rear portion of the top 3, a rear portion of the toe 5, and a rear portion of the sole 4 are formed around the recess O. Further, the head main body 100 integrally includes the hosel 7 via the heel 6.

It is preferable that all of the portions of the head main body 100 as described above are integrally formed by, for example, casting.

Further, the head main body 100 is provided with a face support portion 101 for fixing the face member 200 on the front side of the head.

The face support portion 101 is formed along the inner peripheral edge of the recess O.

In the present embodiment, as shown in FIG. 4, the face support portion 101 includes a top side support portion 103, a sole side support portion 104, and a toe side support portion 105.

Each of the support portions 103, 104 and 105 has a support surface 101*a* which forms a plane extending substantially parallel to the face 2.

<Face Member>

Figure 5:
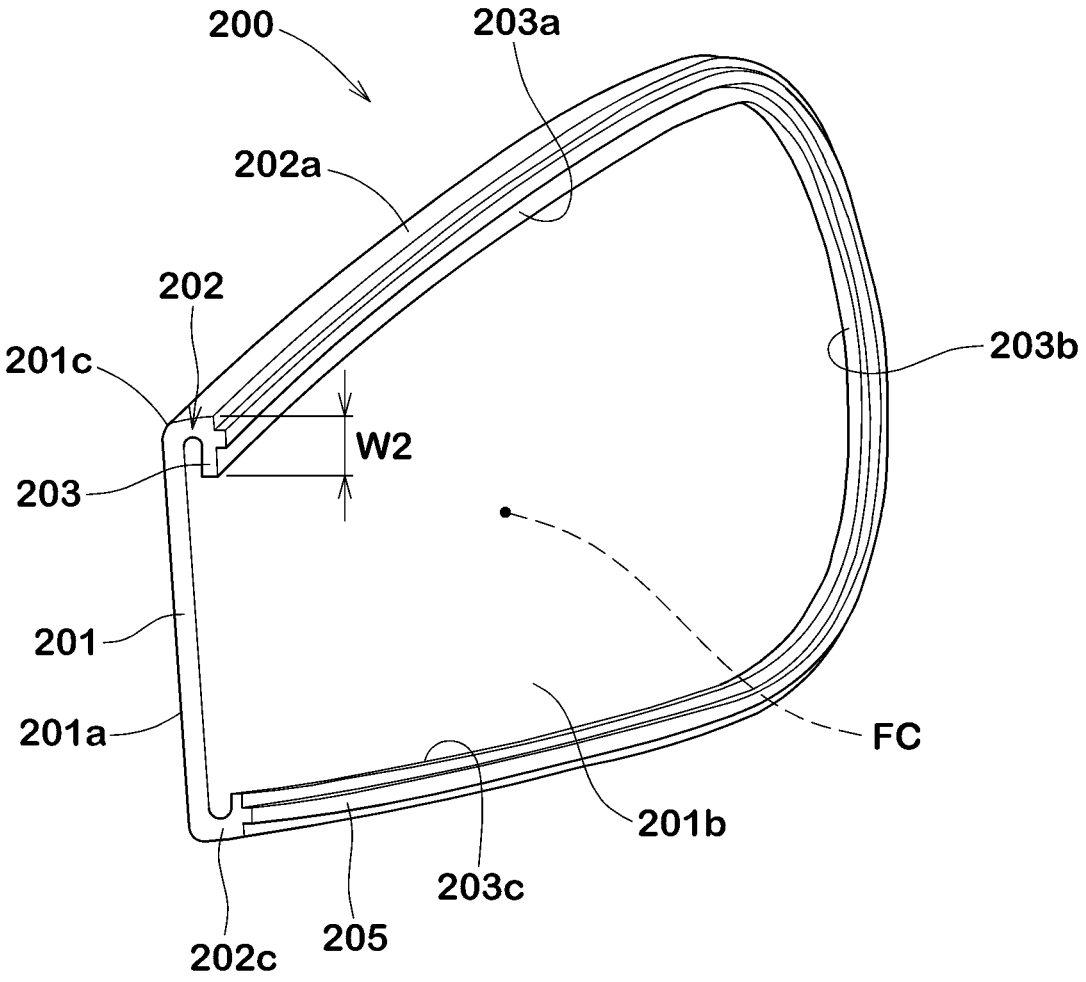
FIG. 5 is a perspective view of the face member as viewed diagonally from the rear surface side.

FIG. 5 is a perspective view of the face member 200 as viewed diagonally from the rear side.

Figure 6:
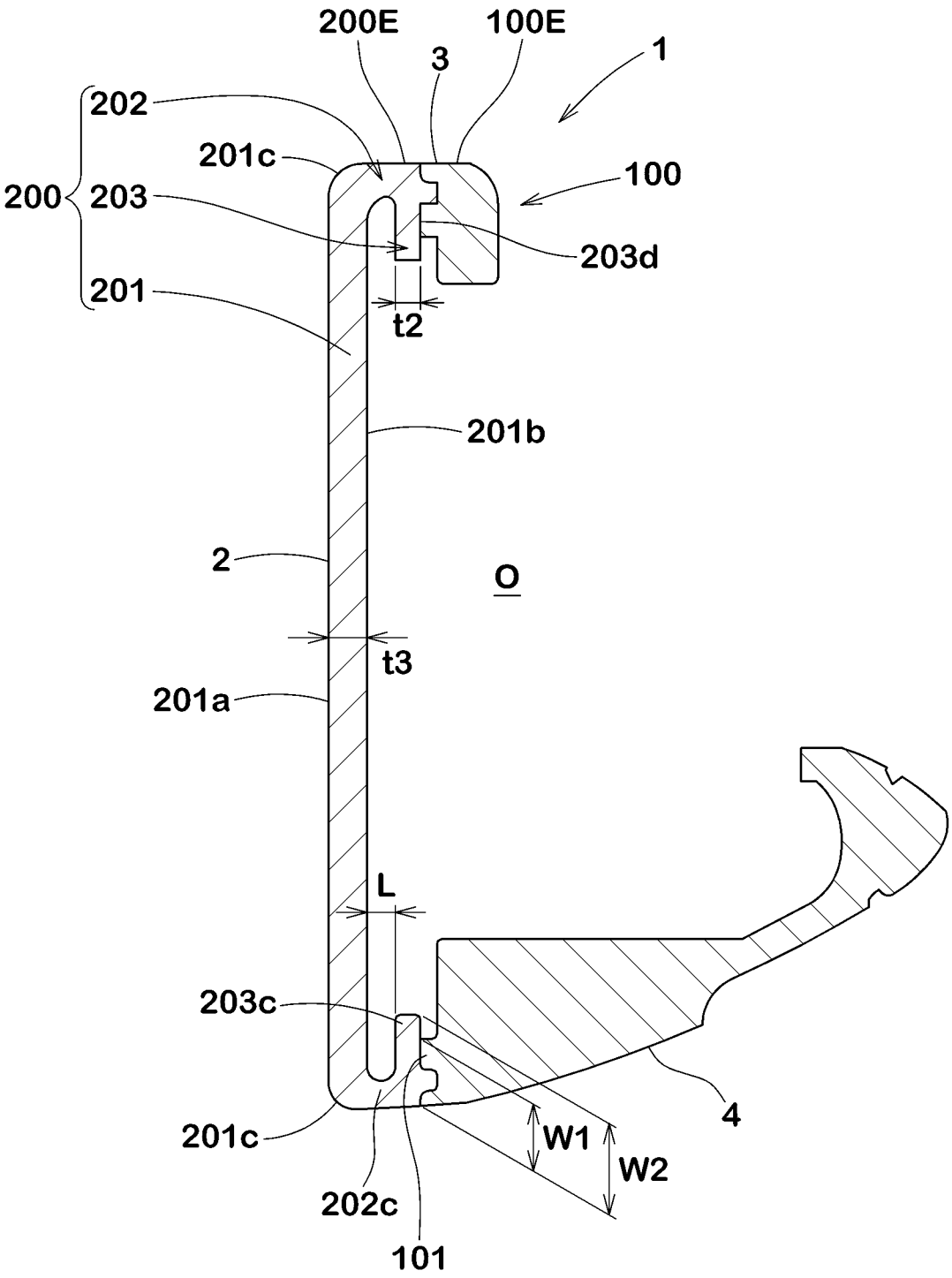
FIG. 6 is a sectional view taken along line IV-IV of FIG. 1.

FIG. 6 is a sectional view taken along line Iv-iv of FIG. 1.

Figure 7:
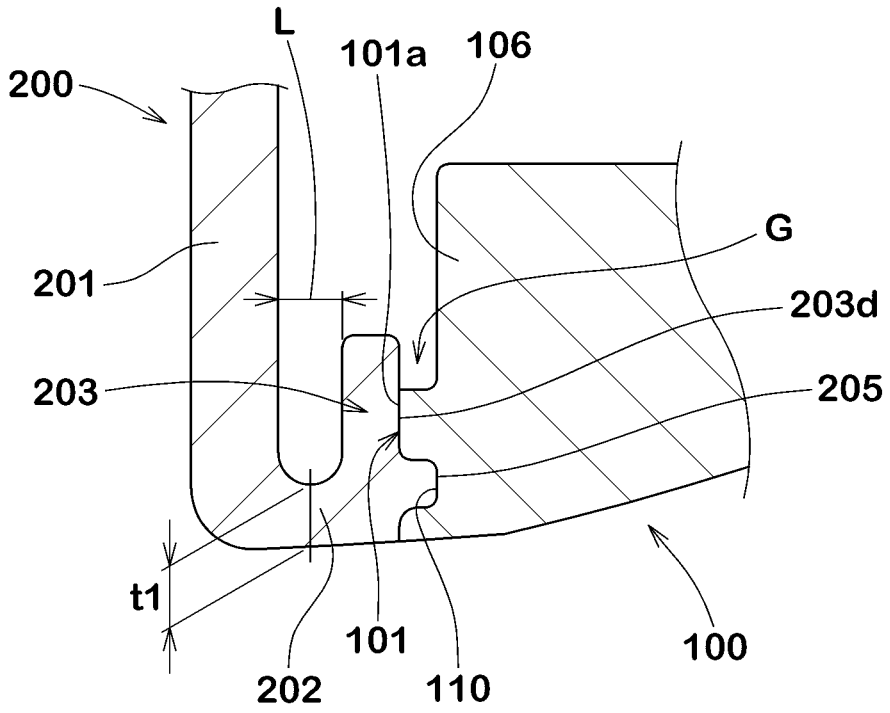
FIG. 7 is a closeup of a part of FIG. 6.

FIG. 7 is a closeup of a part of FIG. 6 on the sole side.

For ease of understanding, in FIG. 6, the face 2 is drawn upright. As shown in FIGS. 5 to 7, the face member 200 comprises a front plate portion 201, a backwardly directed first portion 202 extending rearward from the front plate portion 201, and a centrally directed second portion 203 extending from the backwardly directed first portion 202 toward the face center FC (shown in FIG. 1).

As shown in FIGS. 1 and 4, the front plate portion 201 in the present embodiment forms the face 2 from the top 3 to the sole 4 in the up-down direction.

Further, the front plate portion 201 in the present embodiment forms the face 2 from the toe 5 toward the heel 6 beyond the face center FC to a position short of the hosel 7 in the toe-heel direction.

The front plate portion 201 in the present embodiment, therefore, constitutes a front portion of the top 3, a front portion of the toe 5, and a front portion of the sole 4.

The front plate portion 201 has a front surface 201*a* and a rear surface 201*b*.

The front surface 201*a* constitutes at least a part of the face 2. Preferably, the front surface 201*a* of the front plate portion 201 forms a major portion of the face 2, for example, not less than 40%, preferably not less than 50% of the overall area of the face 2.

More preferably, the front surface 201*a* of the front plate portion 201 forms the entire intended ball striking region defined by the region in which the score lines 8 are formed, including the face center FC as shown in FIG. 1.

As shown in FIGS. 4 to 6, in this example, the backwardly directed first portion 202 extends toward the rear of the head from the outer peripheral edge 201*c* of the front plate portion 201. In the present embodiment, the backwardly directed first portion 202 includes a backwardly directed first portion 202*a* on the top side, a backwardly directed first portion 202*b* on the toe side (FIG. 4), and a backwardly directed first portion 202*c* on the sole side.

Preferably, these backwardly directed first portions 202*a*, 202*b* and 202*c* extend continuously along the outer peripheral edge 201*c*.

In this embodiment, the backwardly directed first portion 202 is not provided on the outer peripheral edge of the front plate portion 201 on the heel side.

However, as another example, the backwardly directed first portion 202 may also be provided on the edge of the face member 200 on the heel side.

The centrally directed second portion 203 extends from the backwardly directed first portion 202 toward the face center FC. The centrally directed second portion 203 is spaced apart from the rear surface 201*b* of the front plate portion 201 by a distance L as shown in FIG. 6. The distance L corresponds to the length of the backwardly directed first portion 202 measured in the direction perpendicular to the front surface of front plate portion.

In the present embodiment, as shown in FIG. 5, the centrally directed second portion 203 includes
a centrally directed second portion 203*a* on the top side,
a centrally directed second portion 203*b* on the toe side, and
a centrally directed second portion 203*c* on the sole side.

Preferably, these centrally directed second portions 203*a*, 203*b* and 203*c* extend continuously along the outer peripheral edge 201*c*. As another example, the centrally directed second portions 203*a*, 203*b* and 203*c* may be formed so as to be separated from each other.

The face member 200 is preferably made of a metal material having a large specific strength, for example, titanium or a titanium alloy.

<Fixing Between the Face Member and the Head Main Body>

In the head 1 in the present embodiment, as shown in FIGS. 6 and 7, the rear surface 203*d* of the centrally directed second portion 203 is fixed to the face support portion 101 of the head main body 100.

In general, in order to increase the bonding strength between the face member 200 and the head main body 100, it is important to increase the bonding area therebetween.

Therefore, the width w1 of the face support portion 101 and the width w2 of the centrally directed second portion 203 shown in FIG. 6, can be larger. Even so, this does not affect the rigidity of the backwardly directed first portion 202.

In other words, in the present embodiment, it is possible to reduce the thickness of the backwardly directed first portion 202 while increasing the joint strength between the face member 200 and the head main body 100. As a result, when the ball is hit, the front plate portion 201 is easily bent, and as a result, the face resilience can be improved.

The width w1 of the face support portion 101 is measured in a direction orthogonal to the outer peripheral surface of the head main body 100.

The width w2 of the centrally directed second portion 203 is measured in a direction orthogonal to the outer peripheral surface of the face member 200.

It is preferable that, as shown in FIG. 6, the outer peripheral surface 200E of the face member 200 is flush with the outer peripheral surface 100E of the head main body 100 neighboring the face member 200, and
the surfaces 100E and 200E form a continuous outer surface of the head 1 in the present embodiment.

Preferably, the outer peripheral surface of the backwardly directed first portion 202 of the face member 200 (namely, the outer peripheral surface 200E of the face member 200) is not fixed to the head main body 100. Thereby, the movement of the outer peripheral portion of the face member 200 is not hindered by the head main body 100, and the face member 200 is more likely to bend when the ball is hit, and thus the face resilience is improved.

<Thickness t1 of Backwardly Directed First Portion>

The minimum thickness t1 (shown in FIG. 7) of the backwardly directed first portion 202 is set to be not more than 4.0 mm, preferably not more than 3.0 mm, more preferably not more than 2.0 mm in order to further enhance the face resilience by decreasing the thickness of the backwardly directed first portion 202.

On the other hand, if the thickness t1 becomes excessively small, the durability of the face member 200 may be decreased, therefore, the thickness t1 is set to be not less than 0.5 mm, preferably not less than 1.0 mm, more preferably not less than 1.3 mm. In this example, the thickness t1 is 1.4 mm.

<Length L of Backwardly Directed First Portion>

To make the backwardly directed first portion 202 longer promotes the bending of the backwardly directed first portion 202 when the ball is hit. Therefore, in order to further enhance the face resilience, the length L of the backwardly directed first portion 202 measured in the direction perpendicular to the face 2 as shown in FIGS. 6 and 7, is set to be not less than 0.5 mm, preferably not less than 1.0 mm, more preferably not less than 1.5 mm.

On the other hand, if the length L of the backwardly directed first portion 202 becomes excessively large, the durability of the face member 200 may be impaired, therefore, the length L is set to be not more than 4.0 mm, preferably not more than 3.5 mm, more preferably not more than 3.0 mm. In this example, the length L is 1.7 mm.

<Thickness t2 of Centrally Directed Second Portion>

In order to further enhance the face resilience, the minimum thickness t2 (shown in FIG. 6) of the centrally directed second portion 203 measured in the direction perpendicular to the face 2 is set to be not more than 2.5 mm, preferably not more than 2.3 mm, more preferably not more than 2.0 mm. on the other hand, if the thickness t2 becomes excessively small, the durability of the face member 200 may be impaired, therefore, the thickness t2 is set to be not less than 0.5 mm, preferably not less than 1.0 mm, more preferably not less than 1.3 mm. In this example, the thickness t2 is 1.5 mm.

<Thickness t3 of Front Plate Portion>

To decrease the thickness t2 of the front plate portion 201 promotes the bending of the front plate portion 201 when the ball is hit. Therefore, in order to further enhance the face resilience, the minimum thickness t3 of the front plate portion 201 is set to be not more than 3.5 mm, preferably not more than 3.3 mm, and more preferably not more than 3.0 mm.

On the other hand, if the thickness t3 becomes excessively small, the durability of the face member 200 may be impaired, therefore, the thickness t3 is set to be not less than 1.7 mm, preferably not less than 2.0 mm, more preferably not less than 2.2 mm. In this example, the thickness t3 is 2.4 mm.

In this embodiment, the head main body 100 is made of stainless steel, and the face member 200 is made of a titanium alloy.

In a combination of such different metal materials, usually, it is difficult to obtain the practical bonding strength required for the head by welding.

Therefore, in the head 1 in the present embodiment, the head main body 100 and the face member 200 are joined by brazing. In such brazing technique, a brazing material is interposed between the head main body 100 and the face member 200, and the brazing material is melted and solidified to join both materials.

The centrally directed second portion 203 may be projected toward the face center FC from the face support portion 101 as shown in FIG. 7. Thereby, when the brazing material interposed between the head main body 100 and the face member 200 is fluidized, the brazing material is prevented from flowing into the gap between the front plate portion 201 and the centrally directed second portion 203 of the face member 200. Thus, there is an advantage such that the finished head 1 can be provided with an excellent appearance.

It is particularly preferable that the head main body 100 is provided with a peripheral weight portion 106 projecting toward the face center FC at a position separated from the centrally directed second portion 203 toward the rear of the head. Thereby, a large amount of weight is distributed to the peripheral portion of the head 1, and the moment of inertia of the head 1 increases.

By providing the peripheral weight portion 106, as shown in FIG. 7, a groove-shaped recess G is formed between the centrally directed second portion 203 and the peripheral weight portion 106. Thereby, when the brazing material interposed between the head main body 100 and the face member 200 is fluidized. it is possible to stay the brazing material in the recess G. Therefore, it is possible to more reliably prevent the brazing material from flowing between the front plate portion 201 and the centrally directed second portion 203 of the face member 200. Therefore, it is possible to provide the head 1 having a further excellent finished appearance.

In order to further enhance such function, the peripheral weight portion 106 may protrude toward the face center FC beyond the centrally directed second portion 203.

Further, in order to increase the joint strength between the head main body 100 and the face member 200, the rear surface 203*d* of the centrally directed second portion 203 may be provided with a protrusion 205 projecting to the rear of the head, and the face support portion 101 may be provided with a recess 110 for fitting the protrusion 205. Thereby, the bonding area between the head main body 100 and the face member 200 is increased, and the bonding strength between them can be increased. Further, such protrusion 205 and recess 110 help to accurately position the head main body 100 and the face member 200 when they are jointed.

In the present embodiment, the protrusion 205 is formed in the form of a rib extending continuously along the outer peripheral edge of the face member 200.

According to such protrusion 205, the recess 110 is formed in the form of a groove extending continuously.

As another example, the protrusion 205 may be collectively formed from a plurality of protrusions intermittently provided along the outer peripheral edge of the face member 200.

According to such protrusions, the recess 110 may be collectively formed from a plurality of recesses intermittently provided. It is of course possible to combine a plurality of the intermittently provided protrusions with the single continuously extending groove.

As another embodiment (not shown), it is also possible that the recess or recesses are provided on the centrally directed second portion 203 of the face member 200, and the protrusion or protrusions are provided on the face support portion 101.

<Further Embodiments>

In the above embodiment, as a preferable example of the face member 200, the backwardly directed first portion 202 and the centrally directed second portion 203 are provided on the upper portion (top 3 side), lower portion (sole 4 side) and toe side portion of the face member 200. However, the present disclosure can be variously embodied without being limited to such arrangement.

For example, the backwardly directed first portion 202 and the centrally directed second portion 203 may be provided in at least one of the upper portion (top 3), lower portion (sole 4), toe side portion (a portion on the toe 5 side), and a heel side portion (a portion on the heel 6 side) of the face member 200. Further, when the backwardly directed first portion 202 and the centrally directed second portion 203 are provided on the above-mentioned portion of the face member 200, for example, provided on the lower portion, these may be provided in at least a part of the lower portion, it may be not necessary to provide in the entire lower portion.

Hereinafter, some other embodiments will be described.

Figure 8:
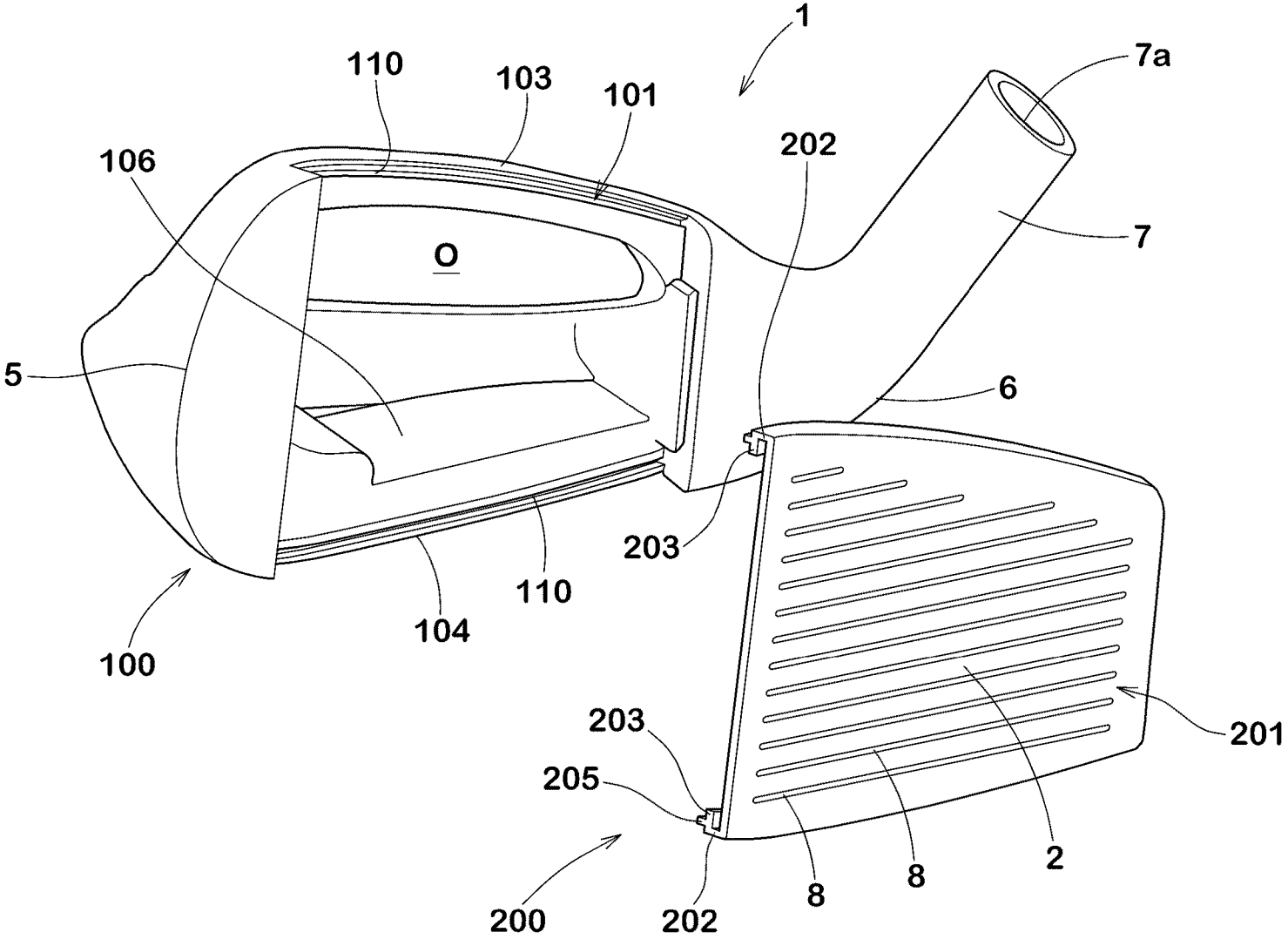
FIG. 8 is an exploded perspective view of a golf club head as another embodiment of the present disclosure.

FIG. 8 shows an exploded perspective view of the head 1 as another embodiment of the present disclosure.

Unlike the former embodiment, the face member 200 in this embodiment does not extend to the toe 5 as shown in FIG. 8. The front plate portion 201 of the face member 200 has a smaller length in the toe-heel direction than that of the face member 200 shown in FIG. 4. Even so the front plate portion 201 includes the face center FC, and constitutes a central portion in the toe-heel direction, of the face 2.

Further, in the face member 200 of this embodiment, the backwardly directed first portion 202 and the centrally directed second portion 203 are provided on the upper portion (top 3) and the lower portion (sole 4) of the face member 200, but not provided on the heel side edge and the toe side edge of the face member 200. Even in such arrangement, the face resilience can be improved over a wide range in the up-down direction of the face 2.

Figure 9:
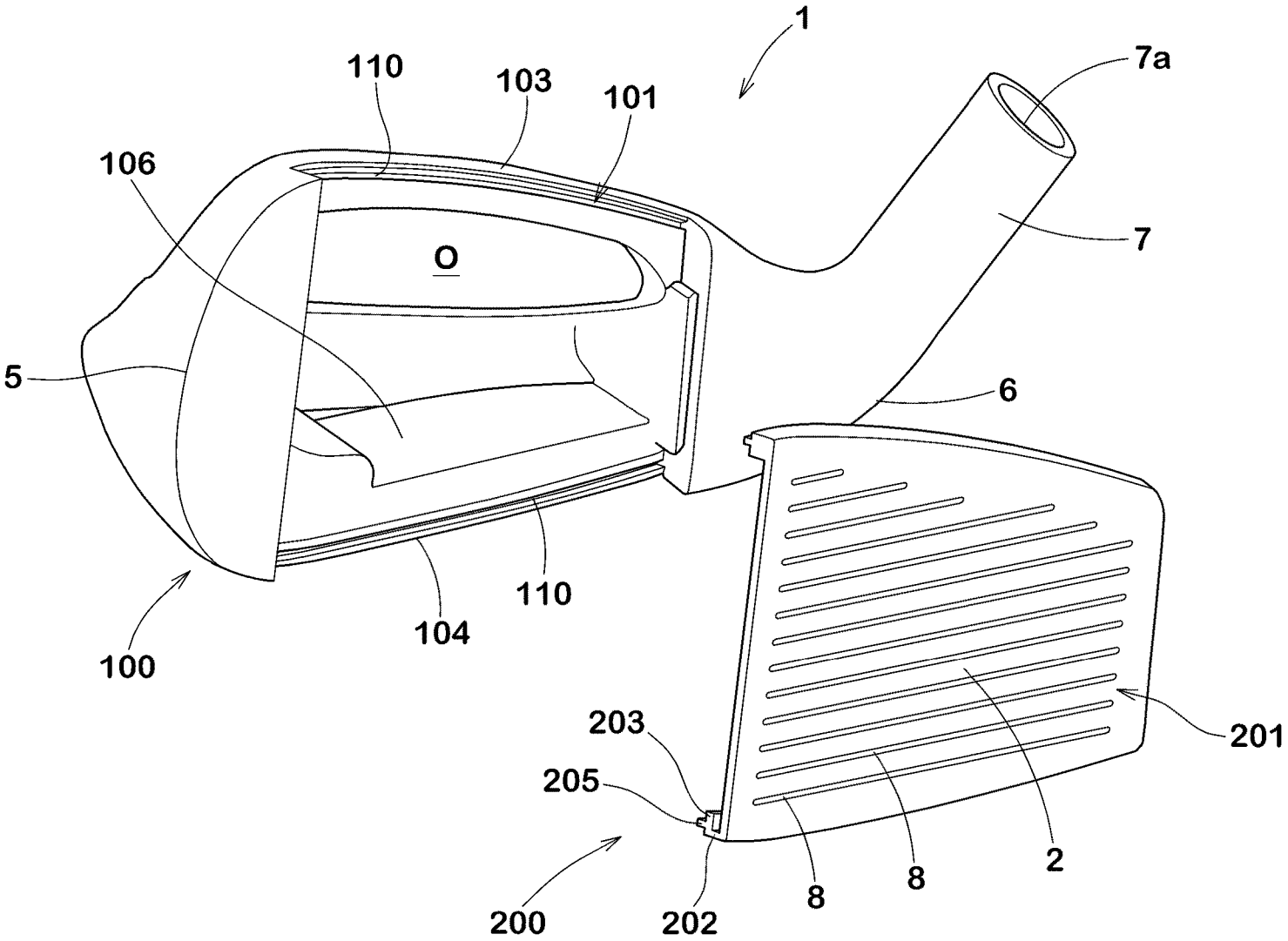
FIG. 9 is an exploded perspective view of a golf club head as still another embodiment of the present disclosure.

FIG. 9 shows an exploded perspective view of the head 1 as still another embodiment of the present disclosure.

In the face member 200 in this embodiment, a combination of the backwardly directed first portion 202 and the centrally directed second portion 203 is provided on only the lower portion (sole 4) of the face member 200, and not provided on each of the upper edge, the toe side edge, and the heel side edge of the face member 200. In this embodiment, a region where the face resilience is high, is extended to a lower region of the face 2. In the case of an iron-type golf club head, there are many opportunities to hit a ball placed directly on the ground, so it is of great significance to increase the face resilience on the sole 4 side of the face 2.

Although not shown, the present disclosure includes such embodiments that the combination of the backwardly directed first portion 202 and the centrally directed second portion 203 is provided only on the edge of the face member 200 extending in the up-down direction on the toe side or on the heel side of the face member 200.

While detailed description has been made of preferable embodiments of the present disclosure, the present disclosure can be embodied in various forms without being limited to the illustrated embodiments.

Comparison Tests

Based on the structures shown in FIGS. 1 to 6, iron golf club heads were experimentally manufactured as test heads (working examples Ex.1-Ex.5 and comparative example Ref.) and tested the face resilience and durability (bonding strength between the face member and the head main body).

The comparative example had the structure shown in FIG. 4 of Patent Document 1, wherein the outer peripheral surface of a face member was supported by the head main body.

In each test head, the face member was made of titanium alloy (6-4 titanium), and the head main body was made of stainless steel (sus630).

Specifications of the test heads are shown in Table 1.

The test methods are as follows.

<Face Resilience Test>

According to the "Interim Procedure for Measuring the coefficient of Restitution of an Iron Clubhead Relative to a Baseline Plate Revision 1.3 Jan. 1, 2006" specified by the united states Golf Association, the coefficient of restitution (coR) of each test head was measured at five locations of the face (the face center, and 5 mm upper side, 5 mm lower side, 5 mm toe side and 5 mm heel side from the face center), and the five measurements were averaged.

The results are indicated in Table 1 by an index based on Ex.1 being 100, wherein the larger the value, the better the face resilience.

<Durability Test>

The test heads were attached to the identical FRP club shafts, and iron clubs (total length 38 inches) were made. Each iron club was attached to a swing robot, and repeatedly hit a golf ball at a head speed of 41 m/s.

The joint between the head main body and the face member was visually observed every 100 hits, and if the joint was failed, the number of hits was recorded as the durability.

The results are indicated in Table 1 by an index based on Ex.1 being 100, wherein the larger the value, the better the durability.

TABLE 1

| Head | Ref. | Ex. 1 | Ex. 2 | Ex. 3 | Ex. 4 | Ex. 5 |
|---|---|---|---|---|---|---|
| face member | | | | | | |
| thickness t3 (mm) | 2.4 | 2.4 | 2.4 | 2.4 | 2.4 | 2.4 |
| thickness t1 (mm) | 2.5 | 1.4 | 0.8 | 2.4 | 1.4 | 1.4 |
| length L (mm) | 1.5 | 1.7 | 1.7 | 1.7 | 3.3 | 1.7 |
| thickness t2 (mm) | 0 | 1.5 | 1.5 | 1.5 | 1.5 | 1.5 |
| width W2 (mm) | 0 | 4.5 | 4.5 | 4.5 | 4.5 | 4.5 |
| protrusion | absent | absent | present | present | present | present |
| head main body | | | | | | |
| width W1(mm) | 2.5 | 3.0 | 3.0 | 3.0 | 3.0 | 3.0 |
| recess | absent | absent | present | present | present | present |
| face resilience | 80 | 100 | 120 | 90 | 115 | 100 |
| durability | 2500 | 3000 | 3000 | 7000 | 4000 | 5000 |

From the test results, it was confirmed that the working example heads were improved in the joint strength between the face member and the head main body, while improving or without sacrificing the face resilience.

Statement of the Present Disclosure

The present disclosure is as follows:

Disclosure 1. A golf club head comprising a head main body and a face member, wherein the head main body is provided, on the front side of the head, with a face support portion to which the face member is fixed, the face member comprises: a front plate portion; a backwardly directed first portion extending backwardly of the head from the front plate portion: and a centrally directed second portion extending toward of a center of the face from the backwardly directed first portion, the front surface of the front plate portion forms at least a part of the face, and a rear surface of the centrally directed second portion is fixed to the face support portion of the head main body.

Disclosure 2. The golf club head according to Disclosure 1, wherein an outer peripheral surface of the backwardly directed first portion of the face member is not fixed to the head main body.

Disclosure 3. The golf club head according to Disclosure 1 or 2, wherein the backwardly directed first portion has a thickness of 0.5 to 4.0 mm.

Disclosure 4. The golf club head according to Disclosure 3, wherein the backwardly directed first portion has a thickness of not more than 2.0 mm.

Disclosure 5. The golf club head according to any one of Disclosures 1 to 4, wherein the centrally directed second portion protrudes toward the center of the face from the face support portion.

Disclosure 6. The golf club head according to any one of Disclosures 1 to 5, wherein the head main body comprises a peripheral weight portion protruding toward the center of the face at a position spaced apart from the centrally directed second portion toward the rear of the head.

Disclosure 7. The golf club head according to Disclosure 6, wherein the peripheral weight portion protrudes toward the center of the face from the centrally directed second portion.

Disclosure 8. The golf club head according to any one of Disclosures 1 to 7, wherein the backwardly directed first portion and the centrally directed second portion are provided in at least one of an upper portion, a lower portion, a toe side portion and a heel side portion of the face member.

Disclosure 9. The golf club head according to any one of Disclosures 1 to 8, wherein the rear surface of the centrally directed second portion is provided with a protrusion projecting to the rear of the head, and the face support portion is provided with a recess for fitting the protrusion.

Disclosure 10. The golf club head according to any one of Disclosures 1 to 9, wherein the face member is made of titanium or a titanium alloy, and the head main body is stainless steel.

Disclosure 11. The golf club head according to any one of Disclosures 1 to 10, wherein the face member and the head main body are connected by brazing.

Disclosure 12. The golf club head according to any one of Disclosures 1 to 11, which is an iron golf club head.

DESCRIPTION OF THE REFERENCE SIGNS

1 head
2 face
100 head main body
101 face support portion
106 peripheral weight portion
110 recess
200 face member
201 front plate portion
201*a* front surface of front plate portion
201*b* rear surface of front plate
202 backwardly directed first portion
203 centrally directed second portion
203*d* rear surface of centrally directed second portion
205 protrusion
FC face center

The invention claimed is:

1. A golf club head comprising a head main body and a face member, wherein the head main body is provided, on a front side of the head main body, with a face support surface to which the face member is fixed, and which has a width W1 when measured inwardly from an outer peripheral surface of the head main body, orthogonally to the outer peripheral surface of the head main body, and the face member comprises:

a front plate portion having a front surface that forms at least a part of a surface for hitting a ball;

a backwardly directed first portion extending backwardly of the head main body from the front plate portion to form an outer peripheral surface on a back side of the face member: and a centrally directed second portion extending from the backwardly directed first portion, inwardly towards a plane oriented perpendicular to the face member and intersecting the face member center to have an inner peripheral edge, and to have a width W2 when measured orthogonally to the outer peripheral surface of the face member from the outer peripheral surface of the face member to the inner peripheral edge, wherein a rear surface of the centrally directed second portion is fixed to the face support surface of the head main body, wherein the rear surface of the centrally directed second portion is provided with a protrusion projecting to a rear of the head, and the face support surface is provided with a recess for fitting the protrusion, and wherein the width W2 of the centrally directed second portion is larger than the width W1 of the face support surface.

2. The golf club head according to claim 1, wherein the outer peripheral surface of the backwardly directed first portion of the face member is not fixed to the head main body.

3. The golf club head according to claim 2, wherein the backwardly directed first portion has a thickness of 0.5 to 4.0 mm.

4. The golf club head according to claim 3, wherein the backwardly directed first portion has a thickness of not more than 2.0 mm.

5. The golf club head according to claim 1, wherein the backwardly directed first portion has a thickness of 0.5 to 4.0 mm.

6. The golf club head according to claim 5, wherein the backwardly directed first portion has a thickness of not more than 2.0 mm.

7. The golf club head according to claim 1, wherein the head main body comprises a peripheral weight portion spaced apart from the centrally directed second portion toward a rear of the head.

8. The golf club head according to claim 7, wherein in a direction orthogonal to the outer peripheral surface of the face member, the peripheral weight portion extends inwardly beyond said inner peripheral edge of the centrally directed second portion.

9. The golf club head according to claim 1, wherein the backwardly directed first portion and the centrally directed second portion are provided in at least one of an upper portion, a lower portion, a toe side portion and a heel side portion of the face member.

10. The golf club head according to claim 1, wherein the face member is made of titanium or a titanium alloy, and the head main body is stainless steel.

11. The golf club head according to claim 1, wherein the face member and the head main body are connected by brazing.

12. The golf club head according to claim 1, which is an iron golf club head.

13. The golf club head according to claim 1, wherein the minimum thickness t2 of the centrally directed second portion measured perpendicularly to the front surface of the front plate portion is not less than 0.5 mm and not more than 2.5 mm.

14. The golf club head according to claim 1, wherein the backwardly directed first portion and the centrally directed second portion are provided in an upper portion, a lower portion, and a toe side portion of the face member.

15. The golf club head according to claim 1, wherein the backwardly directed first portion and the centrally directed second portion are provided in an upper portion, and a lower portion of the face member.

16. An iron golf club head comprising a head main body and a face member, wherein the head main body is provided, on a front side of the head main body, with a face support surface to which the face member is fixed, and which has a width W1 when measured inwardly from an outer peripheral surface of the head main body, orthogonally to the outer peripheral surface of the head main body, and the face member comprises:

a front plate portion of which a front surface forms at least a part of a surface for hitting a ball;

a first portion extending backwardly of the head from the front plate portion to form an outer peripheral surface of the face member; and a second portion extending from the backwardly directed first portion, inwardly towards a plane oriented perpendicular to the face member and intersecting the face member center to have an inner peripheral edge, and to have a width W2 when measured orthogonally to the outer peripheral surface of the face member from the outer peripheral surface of the face member to the inner peripheral edge, wherein a thickness of the first portion is in a range from 0.5 to 4.0 mm, the second portion extends along the rear surface of the front plate portion while keeping a distance L in a range from 0.5 mm to 4.0 mm between a rear surface of the front plate portion and a front surface of the second portion, a minimum thickness t2 of the second portion measured perpendicularly to the front surface of the front plate portion is in a range from than 0.5 mm to 2.5 mm, the width W2 of the second portion is larger than the width W1 of the face support surface, and a rear surface of the second portion is contacted with and fixed to the face support surface of the head main body, and wherein the head main body comprises a peripheral weight portion spaced apart from the rear surface of the second portion toward a rear of the head, and wherein the rear surface of the second portion is provided with a protrusion projecting to the rear of the head, and the face support surface is provided with a recess for fitting the protrusion, and in a direction orthogonal to the outer peripheral surface of the face member, the peripheral weight portion extends inwardly beyond said inner peripheral edge of the second portion.

17. The golf club head according to claim 16, wherein the backwardly directed first portion and the centrally directed second portion are provided in an upper portion, a lower portion, and a toe side portion of the face member.

18. The golf club head according to claim 16, wherein the backwardly directed first portion and the centrally directed second portion are provided in an upper portion, and a lower portion of the face member.

* * * * *